US009107253B2

(12) United States Patent
Kim et al.

(10) Patent No.: US 9,107,253 B2
(45) Date of Patent: Aug. 11, 2015

(54) LIGHTING APPARATUS HAVING A PREDETERMINED LIGHT DISTRIBUTION AREA

(75) Inventors: Jaehwan Kim, Seoul (KR); Limkyoung Ha, Seoul (KR); Dongki Paik, Seoul (KR); Hankyu Cho, Seoul (KR)

(73) Assignee: LG ELECTRONICS, INC., Seoul (KR)

( * ) Notice: Subject to any disclaimer, the term of this patent is extended or adjusted under 35 U.S.C. 154(b) by 273 days.

(21) Appl. No.: 13/570,368

(22) Filed: Aug. 9, 2012

(65) Prior Publication Data

US 2013/0307399 A1 Nov. 21, 2013

(30) Foreign Application Priority Data

May 17, 2012 (KR) ..... 10-2012-0052481

(51) Int. Cl.

| | |
|---|---|
| ***F21V 29/00*** | (2006.01) |
| ***F21V 13/00*** | (2006.01) |
| ***H05B 33/08*** | (2006.01) |
| ***F21K 99/00*** | (2010.01) |
| ***F21V 3/02*** | (2006.01) |
| ***F21V 13/04*** | (2006.01) |
| ***F21V 29/77*** | (2015.01) |
| *F21Y 101/02* | (2006.01) |

(52) U.S. Cl.

CPC ..... *H05B 33/0803* (2013.01); *F21K 9/1355* (2013.01); *F21K 9/50* (2013.01); *F21V 3/02* (2013.01); *F21V 13/04* (2013.01); *F21V 29/777* (2015.01); *F21Y 2101/02* (2013.01)

(58) Field of Classification Search

CPC ..... F21K 9/135; F21K 9/50
USPC ..... 362/294, 241, 243, 245; 313/46
See application file for complete search history.

(56) References Cited

U.S. PATENT DOCUMENTS

| | | | | |
|---|---|---|---|---|
| 2011/0090686 | A1* | 4/2011 | Pickard | 362/235 |
| 2011/0215696 | A1* | 9/2011 | Tong et al. | 313/46 |
| 2012/0176017 | A1* | 7/2012 | Huang | 313/46 |
| 2013/0058098 | A1* | 3/2013 | Kim et al. | 362/294 |

FOREIGN PATENT DOCUMENTS

| | | | |
|---|---|---|---|
| KR | 10-2010-0081558 | | 7/2010 |
| KR | 10-2010-0137752 | | 12/2010 |
| KR | 10-1073927 | B1 | 10/2011 |
| KR | 10-1081391 | B1 | 11/2011 |

* cited by examiner

*Primary Examiner* — Karabi Guharay
(74) *Attorney, Agent, or Firm* — Ked & Associates, LLP

(57) ABSTRACT

A lighting apparatus is provided. The lighting apparatus may include a mounting block provided on a heat sink and having a plurality of light emitting modules installed thereon, and a bulb surrounding the mounting block. One or more reflectors may reflect light emitted by the light emitting modules so as to distribute light within a predetermined light distribution area.

17 Claims, 8 Drawing Sheets

LIGHTING APPARATUS HAVING A PREDETERMINED LIGHT DISTRIBUTION AREA

CROSS-REFERENCE TO RELATED APPLICATION(S)

This application claims priority under 35 U.S.C. §119 to Korean Application No. 10-2012-0052481 filed on May 17, 2012, whose entire disclosure is hereby incorporated by reference.

BACKGROUND

1. Field

This relates to a lighting apparatus, and more particularly, to a lighting apparatus which may omnidirectionally radiate light.

2. Background

Light sources that provide lighting may include, for example, incandescent lamps, discharge lamps, fluorescent lamps, and other such devices may be applied in various environments, such as for domestic use, industrial use, aesthetic purposes and the like. Resistive light sources, such as incandescent lamps, may have relatively low efficiency and high light emission, discharge lamps may have relatively high cost and requires high voltage, and fluorescent lamps may cause environmental problems due to use of mercury. A lighting apparatus including a light emitting diode (LED) may provide color diversity, design autonomy, and other advantages while also addressing some of the shortfalls of these other types of light sources.

BRIEF DESCRIPTION OF THE DRAWINGS

The embodiments will be described in detail with reference to the following drawings in which like reference numerals refer to like elements wherein.

DETAILED DESCRIPTION

Figure 1:
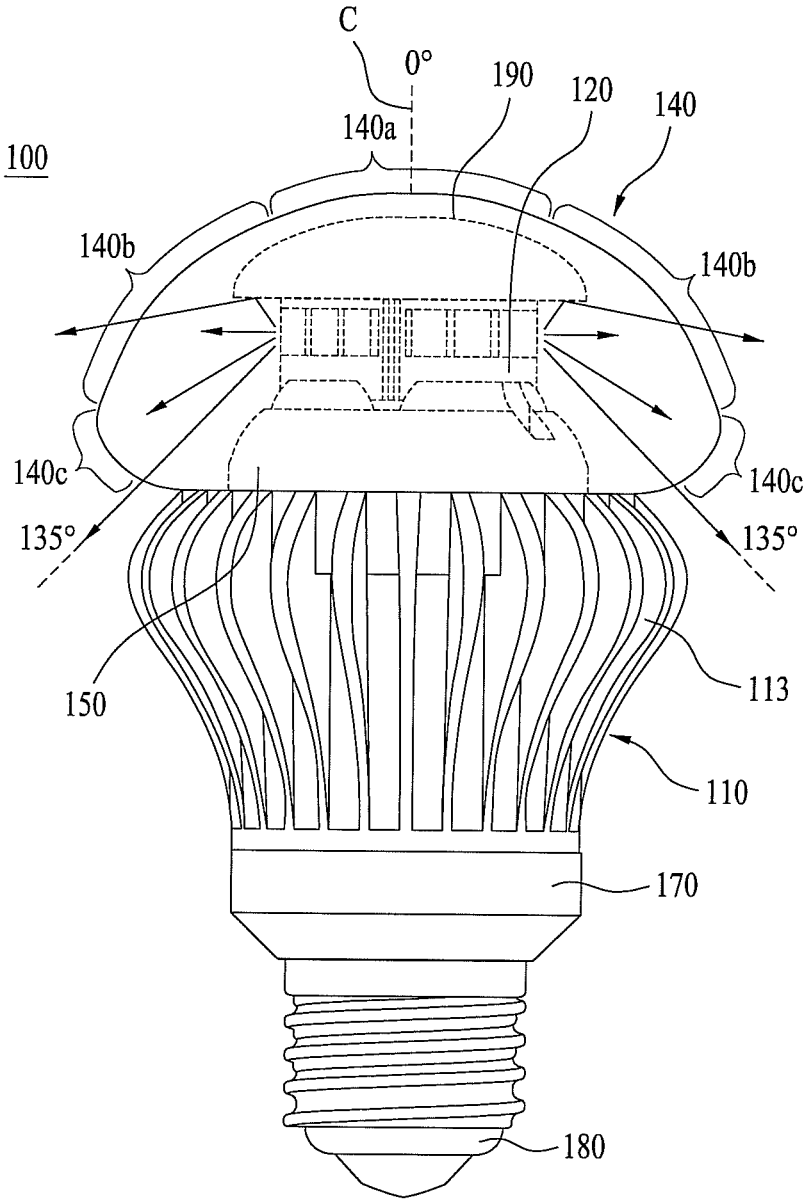
FIG. 1 is a side view of a lighting apparatus in accordance with one embodiment as broadly described herein.

Reference will now be made in detail to the preferred embodiments of the present invention, examples of which are illustrated in the accompanying drawings.

Hereinafter, a lighting apparatus in accordance with various embodiments will be described in detail with reference to the accompanying drawings. The accompanying drawings illustrate exemplary embodiments of the present invention only to describe the disclosure in more detail, but do not limit the technical scope of the disclosure.

In the drawings, the same or similar elements may be denoted by the same reference numerals even though they are depicted in different drawings, and a redundant description thereof will be omitted. For convenience of description, the sizes and shapes of constituent elements shown in the drawings may be exaggerated or reduced.

Further, although terms, such as first, second, etc., may be used to describe various elements, components, regions, layers and/or regions, it will be understood that the these terms are not intended to limit the elements, components, regions, layers and/or regions, but are used only to discriminate one element, component, region, layer and/or region from other elements, components, regions, layer and/or regions.

An LED may include a semiconductor element which emits light when forward voltage is applied thereto. An LED may have a relatively long lifespan and relatively low power consumption and its electrical, optical and physical characteristics may lend themselves to mass production. However, an LED may generate relatively high heat during operation. If this heat is not properly radiated/dispersed through, for example, a heat sink, efficiency of a light apparatus using LEDs may be lowered.

Further, if the heat generated by the LED is transmitted to a component of the lighting apparatus other than the heat sink, the component may be overheated or damaged, or, if the component is a bulb, the bulb may be deformed.

An LED may have a relatively narrow irradiation angle, and thus light distribution characteristics may be affected. Particularly, a lighting apparatus employing LEDs may have a relatively narrow irradiation angle, and if such a lighting apparatus is installed on the ceiling, the lighting apparatus may radiate light only to an area directly under the lighting apparatus or to an area close to the lighting apparatus. Thus, an LED lighting apparatus installed in this manner may provide a sufficient intensity of illumination to the area directly under the lighting apparatus or the area close to the lighting apparatus, but may not provide a sufficient intensity of illumination to a relatively distant space. Therefore, in order to maintain a sufficient intensity of illumination throughout a wide space, a larger number of lighting apparatuses may be required, thus increasing installation and operation costs.

Figure 2:
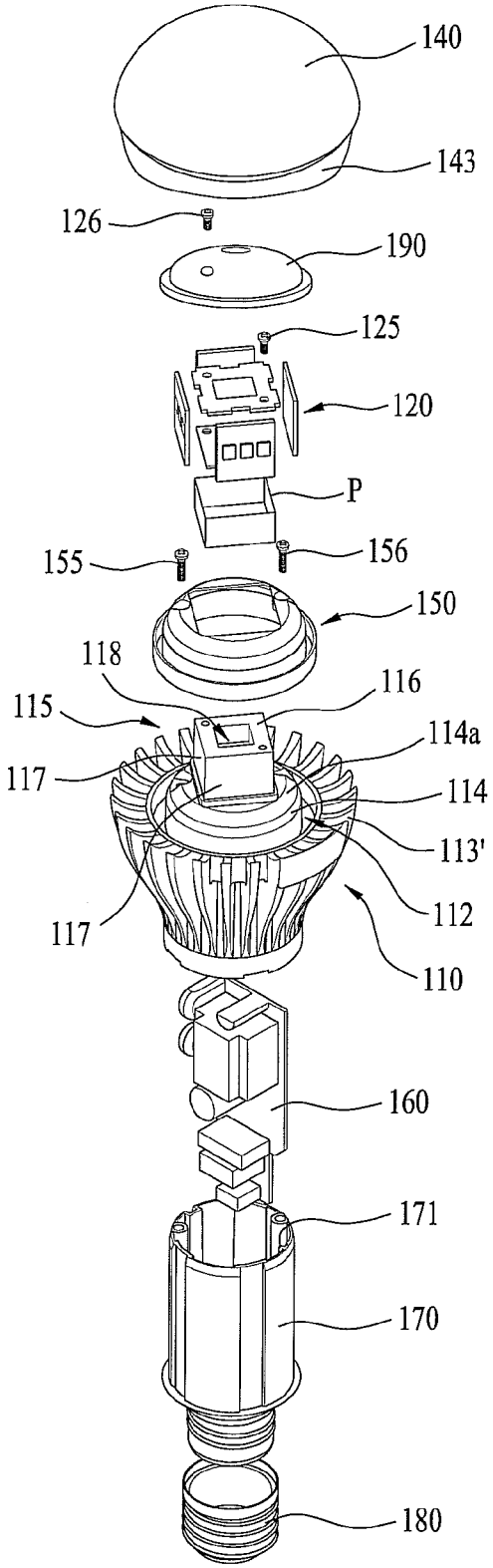
FIG. 2 is an exploded perspective view of the lighting apparatus shown in FIG. 1.

A lighting apparatus 100 in accordance with the embodiment shown in FIGS. 1 and 2 may include a heat sink 110, a mounting block 115, a bulb 140, light emitting modules 120, an electronic module 160, and a first reflector 190.

The heat sink 110 may include a plurality of heat radiation fins 113 and 113', the mounting block 115 may be provided on the heat sink 110 and may have a top surface 116 and a plurality of side surfaces 117, and the bulb 140 may be disposed on the heat sink 110 and surround the mounting block 115. The light emitting modules 120 may each include a first substrate 121 disposed on the side surface 117 of the mounting block 115 and LEDs 122 mounted on the first substrate 121 (see FIG. 3) in order to irradiate light towards a side surface area 140*b* of the bulb 140. The electronic module 160 may be electrically connected to the light emitting modules 120, and the first reflector 190 may be mounted on the mounting block 115 and may reflect light irradiated from the LEDs 122 towards a lower end area 140*c* of the bulb 140.

The heat radiation fins 113 and 113' of the heat sink 110 may be separated from the lower end area 140*c* of the bulb 140 by a designated interval so as to prevent interference with light irritated within a designated light distribution angle by the LEDs 122. Further, the heat radiation fins 113/113' may be shaped and installed so that they do not protrude into an area within a range of 120° to 140° with respect to the central axis C of the heat sink 110. This will be described in more detail later with reference to FIGS. 7 and 8.

As described above, the lighting apparatus 100 may include the heat sink 110 including the mounting block 115 having the top surface 116 and the plurality of side surfaces 117, the bulb 140 disposed on the heat sink 110 and surrounding the mounting block 115 such that a central area 140*a* of the bulb 140 corresponds to a top surface 116 of the mounting block 115, and the light emitting modules 120 each including the first substrate 121 disposed on the side surface 117 of the mounting block 115 and the LEDs 122 mounted on the first substrate 121 to irradiate light towards the side surface area 140*b* of the bulb 140. The lighting apparatus 100 may also include a second reflector 150 disposed on the heat sink 110 and having a surface 152 downwardly inclined from the side surfaces 117 of the mounting block 115 to the heat sink 110 so as to not interfere with light within a designated distribution angle irradiated from the LEDs 122. As described above, the lighting apparatus 100 may also include the first reflector 190 disposed on the mounting block 115 and reflecting light irradiated from the LEDs 122 towards the side surface area 140*b* or the lower end area 140*c* of the bulb 140, and the electronic module 160 electrically connected to the light emitting modules 120. The lighting apparatus 100 may also include a housing 170 accommodating the electronic module 160, and a power socket 180 mounted on the housing 170 and electrically connected to the electronic module 160.

The bulb 140 may have various shapes, taking into consideration various design characteristics, and may diffuse light irradiated from the light emitting modules 120 and adjust the direction of light emitted to the outside of the bulb 140. In one embodiment, if the bulb 140 functions as a diffusion member, the bulb 140 may scatter or diffuse light and may thus remove directionality of light and convert linearly directed light into surface light emitted through the overall surface of the bulb 140.

Figure 7:
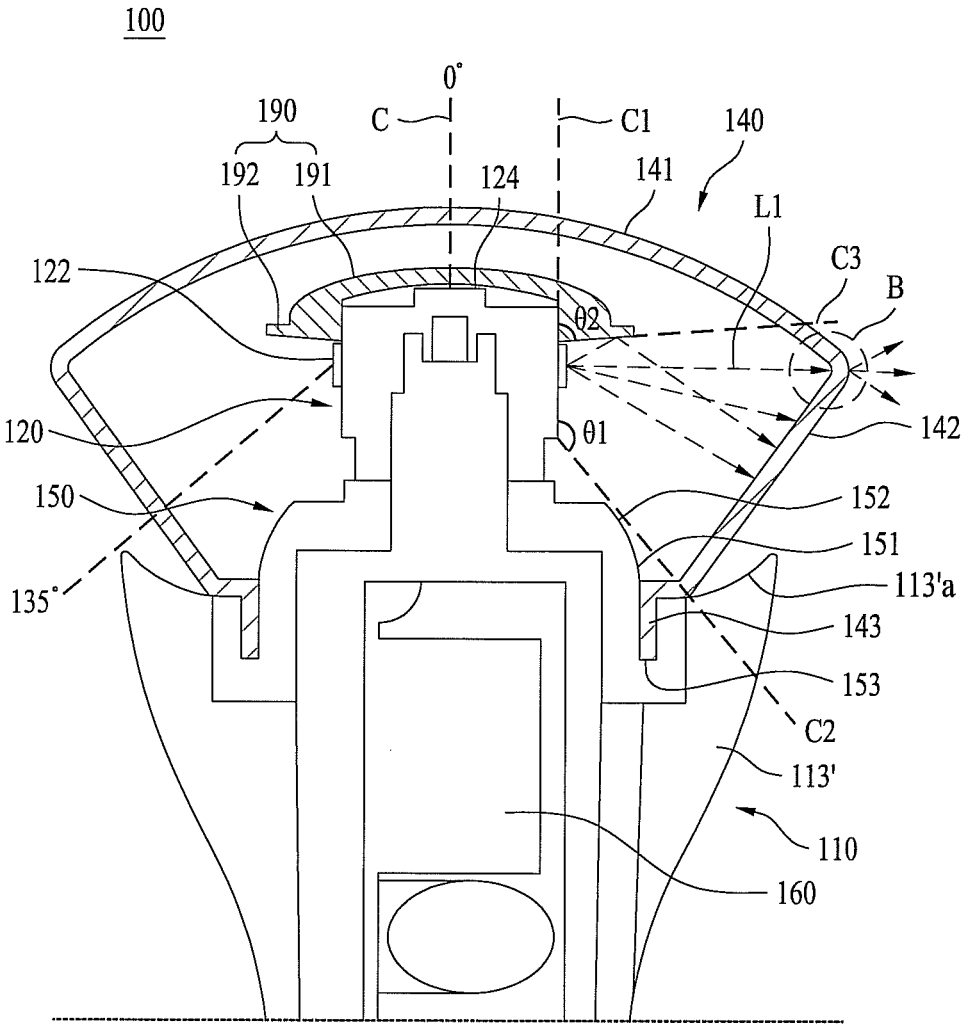
FIG. 7 is a cross-sectional view of the lighting apparatus shown in FIG. 1.
Figure 8:
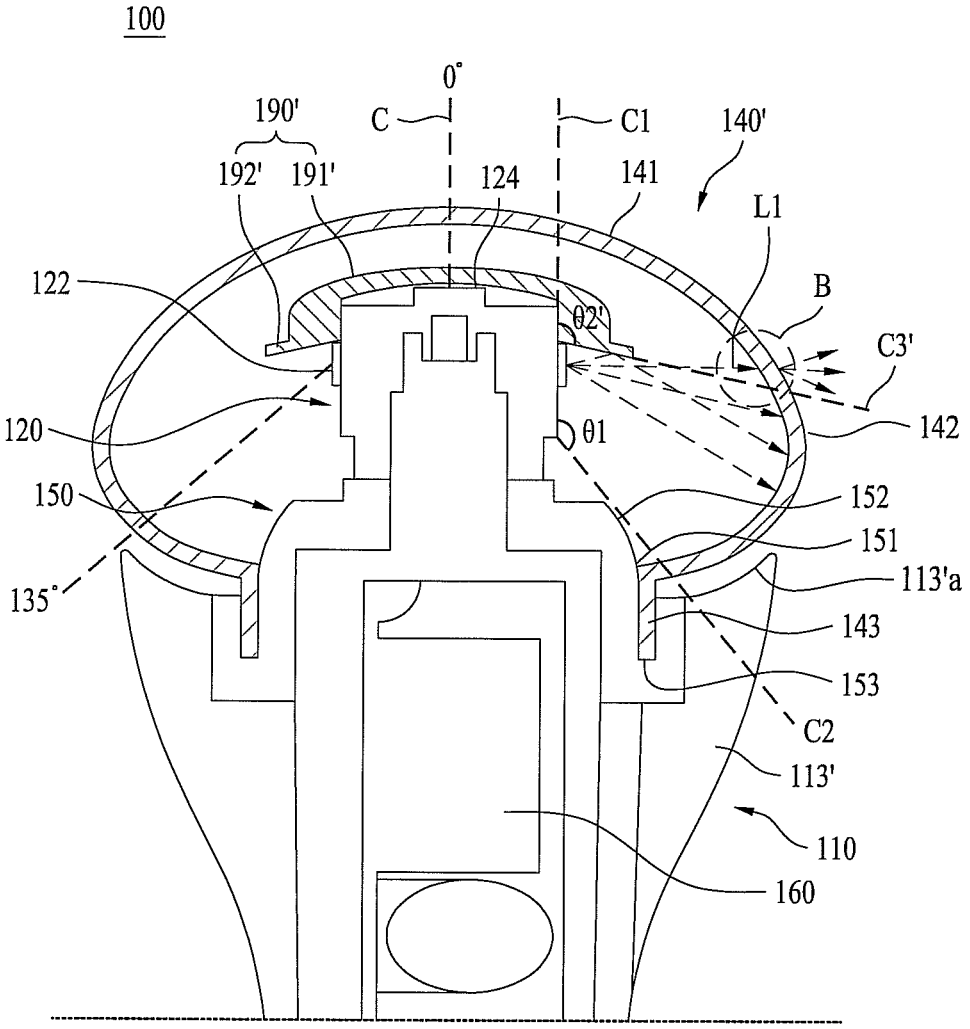
FIG. 8 is a cross-sectional view of a lighting apparatus in accordance with another embodiment as broadly described herein.

Further, the bulb 140 may be divided into the central area 140*a*, the side surface area 140*b* extending from the central area 140*a*, and the lower end area 140*c* close to the heat sink 110 with respect to the central axis C of the heat sink 110. In certain embodiments, the central area 140*a*, the side surface area 140*b* and the lower end area 140*c* may have different curvatures. For example, as shown in FIGS. 7 and 8, the bulb 140 may include a first diffusion part 141 formed at the upper end thereof and a second diffusion part 142 formed at the lower end thereof. The first diffusion part 141 and the second diffusion part 142 may have different curvatures. A mount terminal 143 may be provided at the lower end area 140*c* of the bulb 140. The mount terminal 143 may have a ring shape and may be detachably mounted on the second reflector 150.

The electronic module 160 converting commercial power for input into the light emitting modules 120 may be disposed within the housing 170, and the housing 170 may insulate the heat sink 110 and the electronic module 160 from each other. The power socket 180 to which commercial power is supplied may be mounted on the housing 170. Further, a space between the housing 170 and the electronic module 160 may be filled with an insulating material.

Guide parts 171 to facilitate mounting of the electronic module 160 within the housing 170 may be provided on the housing 170, thereby allowing the mounting position of the electronic module 160 to be confirmed and reducing assembly time.

The housing 170 may be formed integrally with the heat sink 110, may be formed of, for example, metal to perform radiation of heat generated from the light emitting modules 120, or may be formed separately from the heat sink 110 and be mounted on the heat sink 110. Particularly, if the housing 170 is formed separately from the heat sink 110, the housing 170 may be inserted into an insertion part provided at the lower end of the heat sink 110, and may be inserted up to a region adjacent to the mounting block 115 to reduce the electrical connection length with the light emitting modules 120.

The electronic module 160 may also include other components, such as, for example, a converter converting commercial power into DC power and a transformer adjusting an amplitude of voltage.

The heat sink 110 may be formed of, for example, a metal or a resin material having excellent thermal conductivity and may rapidly radiate heat generated from the light emitting modules 120, with the plurality of heat radiation fins 113 increasing a contact area with external air provided on the heat sink 110.

Light emitting modules may be categorized into a top view type in which LEDs are disposed to mainly irradiate light towards the central area 140*a* of the bulb 140, and a side view type in which LEDs are disposed to mainly irradiate light towards the side surface area 140*b* of the bulb 140. In the exemplary embodiment shown in FIGS. 1-4, the light emitting module 120 is a side view type.

As described above, the light emitting module 120 may include the first substrate 121 disposed on the side surface 117 of the mounting block 115, and one or more LEDs 122 mounted on the first substrate 121. The mounting block 115 may have the shape of a polygonal prism having three to N (N>3) side surfaces, and a plurality of light emitting modules 120 respectively mounted on the side surfaces 117 of the mounting block 115. In such an arrangement, the first substrate 121 may denote substrates mounted on each of the side surfaces 117 of the mounting block 115, and a second substrate 123, to be described later, may denote a substrate mounted on the top surface 116 of the mounting block 115.

The light emitting modules 120 may include the second substrate 123 disposed on the top surface 116 of the mounting block 115 and electrically connected to a connector 161 of the electronic module 160. The second substrate 123 may also be electrically connected to the first substrates 121, and thus the electronic module 160 may be electrically connected to the first substrates 121 through the second substrate 123. That is, power may be supplied to the second substrate 123 through the connector 161 of the electronic module 160, and then supplied to the LEDs 122 of the first substrates 121.

A through hole 118 may be provided in the mounting block 115 through which the connector 161 of the electronic module 160 electrically connected to the second substrate 123 may pass. That is, the mounting block 115 may have the shape of a hollow polygonal prism, and in one embodiment, the mounting block 115 may have a hollow regular prism shape and the light emitting modules 120 may be respectively mounted on the four side surfaces 117 of the mounting block 115.

Figure 3:
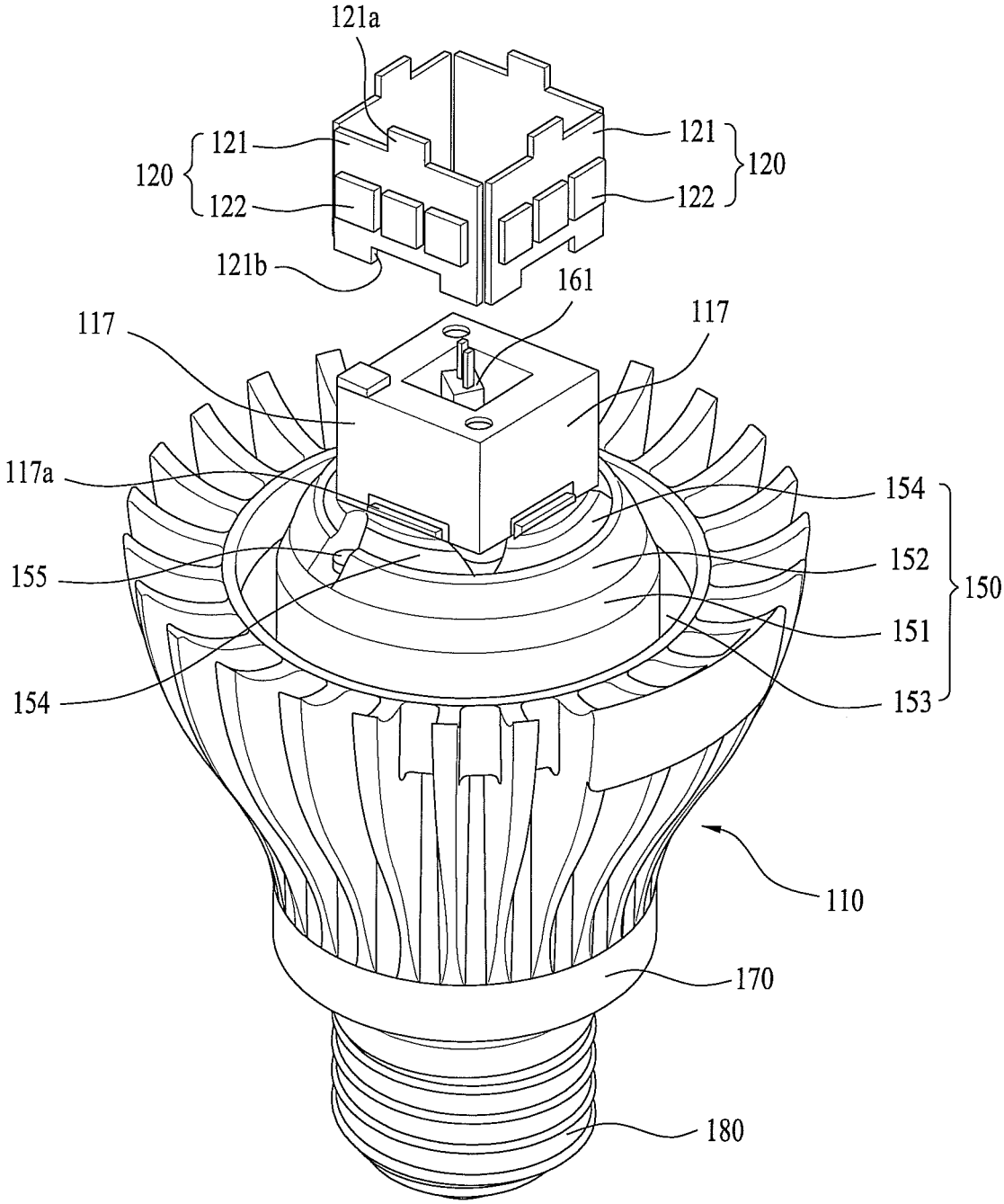
FIGS. 3 and 4 are partial disassembled and assembled perspective views of the lighting apparatus shown in FIGS. 1 and 2.
Figure 4:
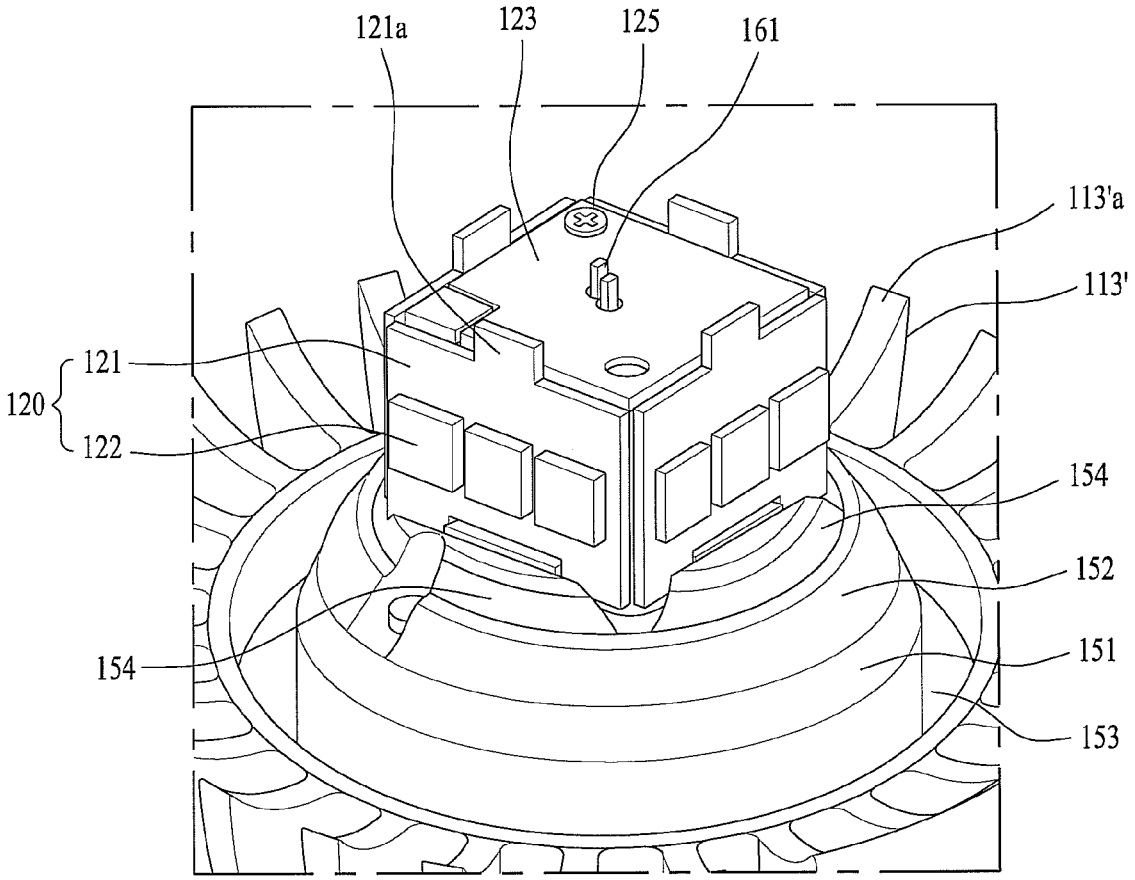

With reference to FIG. 3, protrusions 117*a* may be provided on the side surfaces 117 of the mounting block 115, and grooves 121*b* into which the protrusions 117*a* are inserted may be provided on the first substrates 121. Therefore, the first substrates 121 may be easily mounted on the side surfaces 117 of the mounting block 115 and the mounting positions of the first substrates 121 may be easily aligned by the protrusions 117*a* and the grooves 121*b*.

The mounting block 115 may be formed of, for example, a metal or a resin material having high thermal conductivity in order to rapidly transmit light generated from the light emitting modules 120 to the heat sink 110, and may be formed integrally with the upper portion of the heat sink 110.

The lighting apparatus 100 may also include a thermal conductive pad P disposed between the mounting block 115 and the light emitting modules 120.

With reference to the exemplary embodiments shown in FIGS. 7 and 8, if a light flux of 5% or more at a light distribution angle of 135° or more with respect to the central axis C of the heat sink 110 is secured and the mean light flux deviation of 20% or less at a light distribution angle of 0° to 135° with respect to the central axis C of the heat sink 110 is achieved, the lighting apparatus 100 may satisfy omnidirectional light distribution requirements.

However, the LEDs 122 forming the light emitting modules 120 may have a relatively strong straightness of light and a relatively narrow light distribution angle of, for example, about 120°. In the case of this type of side view type light emitting modules 120, light at some light distribution angles may not be radiated to the lower end area 140*c* of the bulb 140, and the above-described omnidirectional light distribution requirements may not be fully satisfied.

In order to provide for omnidirectional light distribution, the first reflector 190 may reflect light irradiated from the LEDs 122 to the side surface area 140*b* or the lower end area 140*c* of the bulb 140.

Figure 5:
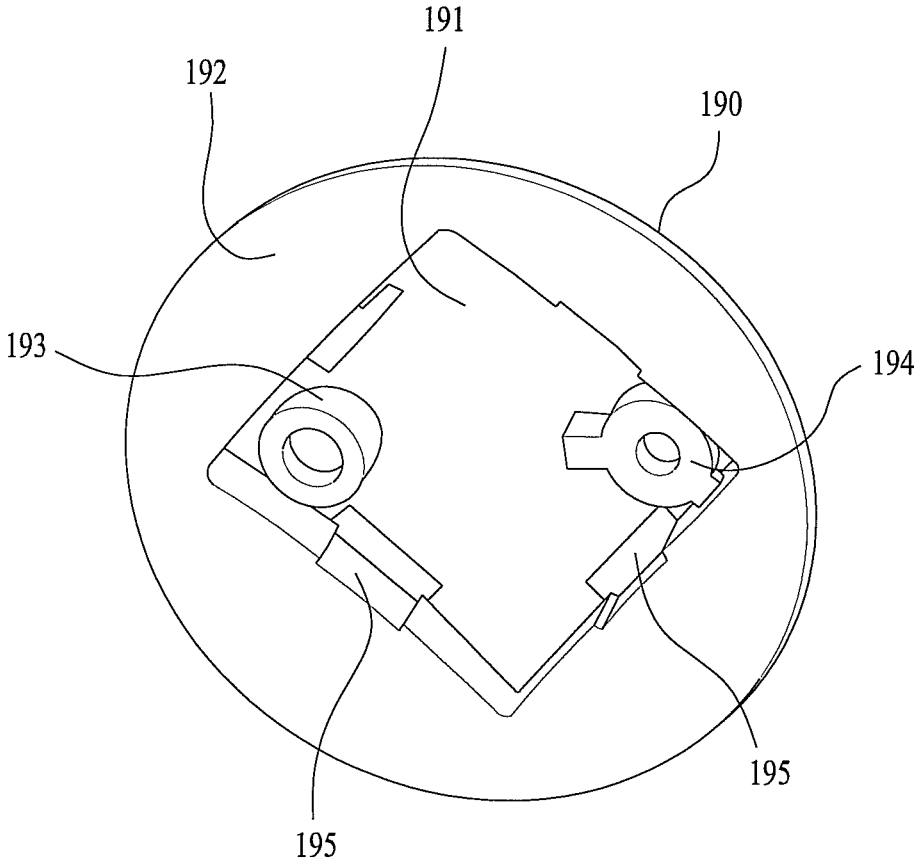
FIG. 5 is a rear perspective view of a first reflector of the lighting apparatus shown in FIG. 1.

Specifically, with reference to FIG. 5, the reflector 190 may include a cap part 191 surrounding the upper portion of the mounting block 115 and a reflective part 192 extending from the outer circumferential surface of the cap part 191. The reflective part 192 may have a ring shape. If the light emitting modules 120 are disposed in a radial shape on the respective side surfaces 117 of the mounting block 115, the reflective part 192 having the ring shape may reflect light irradiated from the respective LEDs 122 towards the side surface area 140*b* or the lower end area 140*c* of the bulb 140.

With reference to FIGS. 2 and 5, the lighting apparatus 100 may include a first fastener 125 passing through the second substrate 123 and fixed to the mounting block 115, and a second fastener 126 passing through the first reflector 190 and the second substrate 123 and fixed to the mounting block 115. The above-described second substrate 123 and first reflector 190 may be fixed to the mounting block 115 by the first fastener 125 and the second fastener 126.

With reference to FIG. 5, an accommodation recess 193 into which a part of the first fastener 125 is inserted and a through boss 194 through which the second fastener 126 passes may be provided at the cap part 191 of the first reflector 190. Therefore, if the first reflector 190 is mounted on the light emitting modules 120, the first fastener 125 is not exposed to the outside.

Mounting grooves 195 may be provided at the cap part 191 of the first reflector 190, and mounting protrusions 121*a* provided at the first substrates 121 may be inserted into the mounting grooves 195. Therefore, the first reflector 190 may be easily mounted on the first substrates 121 and the mounting position of the first reflector 190 may be easily aligned by the mounting protrusions 121*a* and the mounting grooves 195.

Since the first reflector 190 is fastened to the top surface 116 of the mounting block 115, with the cap part 191 surrounding a boundary between the second substrate 123 and the first substrates 121 and the connector 161, the lighting apparatus 100 may have an appealing external appearance quality.

Further, the reflective part 192 may be upwardly inclined (with reference to FIG. 7) or downwardly inclined (with reference to FIG. 8) at a designated angle with respect to the side surfaces 117 of the mounting block 115. In FIGS. 7 and 8, C3 and C3' respectively represent lines extending from the reflective part 192 of the first reflector 190, and θ2 and θ2' respectively represent inclination angles of the lines C3 and C3' with respect to a line C1. In one embodiment, θ2 may be 70° to 90°, and θ2' may be 90° to 110°. That is, the reflective part 192 of the first reflector 190 may be upwardly or downwardly inclined at an angle of about 20° with respect to an optical axis L1 of the LEDs 122, and may exhibit various light distribution characteristics based on their upward inclination or downward inclination.

As discussed above, the lighting apparatus 100 may include the second reflector 150 mounted on the heat sink 110 and having downwardly inclined surfaces 152 and 154 that extend towards the heat sink 110 from the side surfaces 117 of the mounting block 115 so as to prevent interference with light within a designated light distribution angle irradiated from the LEDs 122.

Prevention of interference with light within the designated light distribution angle irradiated from the LEDs 122 not only means that components (for example, the second reflector) are not located in an area within the light distribution angle of the LEDs 122, but also that light irradiated from the LEDs 122 is not reflected towards the central area 140*a* of the bulb 140, but is reflected towards the side surface area 140*b* and/or the lower end area 140*c* of the bulb 140.

The second reflector 150 may radiate light at a designated light distribution angle, irradiated from the side view type light emitting modules 120, towards the side surface area 140*b* and the lower end area 140*c* of the bulb 140 together with the first reflector 190.

The inclined surfaces 152 and 154 of the second reflector 150 may be downwardly inclined at an angle of, for example, 120° to 140° with respect to the side surfaces 117 of the mounting block 115. In more detail, the inclined surfaces 152 and 154 of the second reflector 150 may be downwardly inclined at an angle of 120° to 140° with respect to the central axis C of the mounting block 115. This angle takes into consideration the light distribution angle (about 120°) of the LEDs 122, and may be determined within the above angle range in consideration of the separation distance between the second reflector 150 and the LEDs 122, the size of the second reflector 150, and other such factors.

With reference to FIGS. 7 and 8, the lighting apparatus 100 may emit light irradiated from the LEDs 122 towards the side surface area 140*b* and the lower end area 140*c* of the bulb 140 through the side view type light emitting modules 120 and the second reflector 150 having the inclined surface 152, and may thus satisfy the omnidirectional light distribution requirements.

In FIGS. 7 and 8, C2 may represent a line extending towards the inclined surfaces 152 and 154 of the second reflector 150, and 01 may represent an inclination angle of the line C2 with respect to the line C1. Therefore, θ1 may be 120° to 140°.

With reference to FIG. 2, a mount part 114 in which the mounting block 115 is located may be provided on the heat sink 110, and a recess 112 into which the second reflector 150 is inserted may be provided between the mount part 114 and the heat radiation fins 113/113'.

The second reflector 150 may include a ring 151 surrounding a partial area of the mount part 114 of the heat sink 110, and an insertion groove 153 provided at the outer circumferential surface of the ring 151 such that the bulb 140 is inserted into the insertion groove 153.

The inclined surfaces 152 and 154 of the second reflector 150 may include a first inclined surface 152 formed in the circumferential direction of the upper end of the ring 151, and second inclined surfaces 154 formed at the upper end of the first inclined surface 152 so as to partially surround a portion of the first substrates 121.

The first inclined surface 152 and the second inclined surfaces 154 may be downwardly inclined at an angle of 120° to 140° with respect to the central axis C of the mounting block 115. The first inclined surface 152 and the second inclined surfaces 154 may be inclined at the same angle, or may be inclined at different angles.

Further, the second inclined surface 154 may have a structure that surrounds a partial area of the first substrate 121, particularly, an area of the first substrate 121 including the groove 121*b*, and may thus stably support the first substrate 121. That is, the second reflector 150 may support the first substrates 121 as well as provide a space in which the bulb 140 is mounted.

Through the first inclined surface 152 and the second inclined surfaces 154 having the above structure, interference of light irradiated from the LEDs 122 with the second reflector 150 within a designated light distribution angle may be prevented, or light irradiated from the LEDs 122 may be reflected to the side surface area 140*b* and/or the lower end area 140*c* of the bulb 140.

As described above, a lighting apparatus 100 as embodied and broadly described herein may uniformly emit light irradiated from the LEDs 122 to the side surface area 140*b* and the lower end area 140*c* of the bulb 140 through the second reflector 150 located below the LEDs 122 forming the side view type light emitting modules 120 and the first reflector 190 located above the LEDs 122, and may thus satisfy the above omnidirectional light distribution requirements.

Further, in addition to satisfaction of the omnidirectional light distribution requirements, a lighting apparatus 100 as embodied and broadly described herein may uniformly radiate light irradiated from the LEDs 122 to the side surface area 140*b* and the lower end area 140*c* of the bulb 140 through the first reflector 190 and the second reflector 150, and may thus provide light to a wider space as compared to a case in which light from the LEDs 122 is radiated only to the central area 140*a* of the bulb 140.

In order to improve rear light distribution characteristics and/or scattering characteristics, the bulb 140 may include the first diffusion part 141 formed at the upper end thereof and the second diffusion part 142 formed at the lower end thereof. The first diffusion part 141 and the second diffusion part 142 may have different curvatures. For example, the diameter of the second diffusion part 142 may linearly decrease as the second diffusion part 142 becomes more distant from the LEDs 122 (with reference to FIG. 7).

Further, in order to increase scattering characteristics, the LEDs 122 may be located at a boundary B between the first diffusion part 141 and the second diffusion part 142. For example, the LEDs 122 may be disposed such that the optical irradiation axis L1 having the maximum light amount passes through the boundary B between the first diffusion part 141 and the second diffusion part 142.

Hereinafter, another function of the second reflector 150 will be described in detail.

As described above, the mount part 114 on which the mounting block 115 is provided and the recess 122 into which the insertion groove 153 of the second reflector 150 is inserted may be provided at the upper end of the heat sink 110, and an insertion part into which the housing 170 is inserted may be provided at the lower end of the heat sink 110. Further, the recess 112 may be provided in a space between the mount part 114 and the heat radiation fins 113, and the mount part 114 may protrude further upward from the heat sink 110 than the heat radiation fins 113.

During operation of the lighting apparatus 100, the light emitting modules 120 generate a large amount of heat, and such heat is emitted to the outside through the heat sink 110. When the bulb 140 directly the heat sink 110, heat generated from the light emitting modules 120 may be transmitted to the bulb 140 through the heat sink 110, and bulb 140 may be deformed by such high temperature heat.

In order to prevent such deformation of the bulb 140, the lighting apparatus 100 in accordance with this embodiment may include the second reflector 150 disposed between the heat sink 110 and the bulb 140 to reduce the amount of heat transmitted from the heat sink 110 to the bulb 140. That is, the second reflector 150 may separate the heat sink 110 and the bulb 140 from each other so as to prevent direct contact between the heat sink 110 and the bulb 140. For example, the second reflector 150 may include the ring 151 surrounding a partial area or more of the mount part 114, and the insertion groove 153 provided on the outer circumferential surface of the ring 151 such that the bulb 140 is inserted into the insertion groove 153.

If the second reflector 150 passes through the recess 112 and is fastened to the heat sink 110, heat of the heat sink 110 may be transmitted to the mount end 143 of the bulb 140 by fastening devices formed of, for example, a metal material, and thus the second reflector 150 may be fastened to the upper portion of the mount part 114 through one or more fastening devices 155 and 156.

Figure 6:
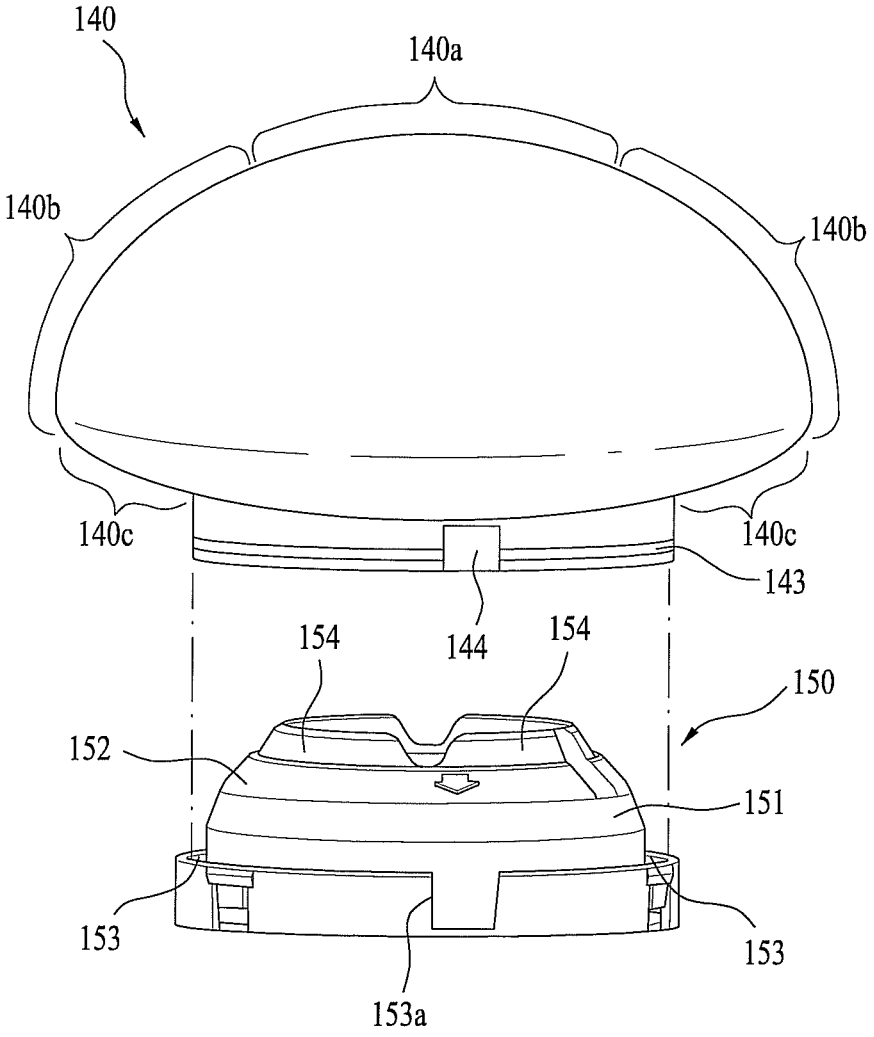
FIG. 6 is a side view of a bulb and a second reflector of the lighting apparatus shown in FIG. 1.

Further, with reference to FIG. 6, a protrusion 144 may be provided on one of the mount terminal 143 of the bulb 140 or the insertion groove 153 of the second reflector 150, and a groove 153*a* into which the protrusion 144 is inserted may be provided on the other of the mount terminal 143 or the insertion groove 153. Thereby, the bulb 140 and the insertion groove 153 may be connected in a state in which the protrusion 144 is inserted into the groove 153*a* without use of a separate fastening device, and the bulb 140 may be detachably mounted on the second reflector 150.

As shown in FIG. 6, the protrusion 144 may be provided on the mount terminal 143 of the bulb 140, and the groove 153*a* into which the protrusion 144 is inserted may be provided on the insertion groove 153 of the second reflector 150.

In certain embodiments, the second reflector 150 may be fastened directly to the heat sink 110 and thus may be formed of a material having excellent heat resistance, such as, for example, a material having low thermal conductivity to reduce heat transmitted from the heat sink 110 to the bulb 140, and high reflectivity to reflect light irradiated from the light emitting modules 120 to omnidirectional areas of the bulb 140.

Further, an inclined part 114*a* may be provided in the circumferential direction of the upper end of the mount part 114 of the heat sink 110. The inclined part 114*a* may have the same inclination angle of the first inclined surface 152 of the second reflector 150.

The above-described second reflector 150 may radiate light at a designated light distribution angle, irradiated from the side view type light emitting modules 120, towards the side surface area 140*b* and the lower end area 140*c* of the bulb 140 together with the first reflector 190, and may include the plural inclined surfaces 152 and 154 to prevent interference with light irradiated from the LEDs 122 within a designated light distribution angle or to reflect the light towards the side surface area 140*b* or the lower end area 140*c* of the bulb 140.

If the heat radiation fins 113/113' excessively protrude towards the bulb 140, light irradiated from the LEDs 122 or light reflected through the first reflector 190 and/or the second reflector 150 may collide with the heat radiation fins 113/113', and thus it may be difficult to obtain desired light distribution characteristics.

Therefore, the heat radiation fins 113 or 113' may be separated from the lower end area 140*c* of the bulb 140 by a designated interval so as to prevent such interference, such as for example, may be separated from the lower end area 140*c* of the bulb 140 by 3 mm to 5 mm.

Further, the heat radiation fins 113/113' may include inclined surfaces 113'*a* having designated curvature formed at regions thereof corresponding to the lower end area 140*c* of the bulb 140, and may have a convex structure (in case of the heat radiation fins 113) or a concave structure (in case of the heat radiation fins 113') towards the bulb 140.

As previously discussed, the heat radiation fins 113/113' are separated from the lower end area 140*c* of the bulb 140 by a designated interval so as to prevent interference with light within a designated light distribution angle irradiated from the LEDs 122 regardless of the shape of the heat radiation fins 113/113', and the heat radiation fins 113/113' may be provided so as not into protrude to an area within a range of 120° to 140° with respect to the central axis C of the heat sink 10 in the same manner as the inclined surfaces 152 and 154 of the second reflector 150 (with reference to FIG. 1).

As apparent from the above description, a lighting apparatus in accordance with embodiments as broadly described herein may radiate light irradiated from LED light sources at a uniform light amount throughout omnidirectional areas of a bulb.

Further, lighting apparatus in accordance with embodiments as broadly described herein may light a wider space using light irradiated from the LED light sources.

Further, a lighting apparatus in accordance with embodiments as broadly described herein may reduce heat transmitted from a heat sink to the bulb.

Moreover, a lighting apparatus in accordance with embodiments as broadly described herein may reduce the number of parts, reduce manufacturing costs, and increase mass-production possibility.

A lighting apparatus is provided which omnidirectionally radiates light irradiated from LED light sources at a uniform light amount.

A lighting apparatus is provided which lights a wider space using light irradiated from LED light sources.

A lighting apparatus is provided which reduces heat transmitted from a heat sink to a bulb.

A lighting apparatus is provided which reduces the number of parts, reduces manufacturing costs, and increases mass-production possibility.

A lighting apparatus embodied and broadly described herein may include a heat sink provided with a plurality of heat radiation fins, a mounting block provided on the heat sink and having an top surface and a plurality of side surfaces, a bulb disposed on the heat sink and the surrounding the mounting block, light emitting modules, each of which includes a first substrate disposed on each of the plurality of side surfaces of the mounting block and LEDs mounted on the first substrate to irradiate light towards a side surface area of the bulb, a electronic module electrically connected to the light emitting modules, and a first reflector mounted on the mounting block and reflecting light irradiated from the LEDs towards a lower end area of the bulb.

The plurality of heat radiation fins of the heat sink may be separated from the lower end area of the bulb by a designated interval so as to prevent interference with light within a designated light distribution angle irradiated from the LEDs.

Inclined surfaces having designated curvature may be formed at regions of the plurality of heat radiation fins corresponding to the lower end area of the bulb.

The plurality of heat radiation fins may be provided so as not to protrude to an area of a range of 120° to 140° with respect to the central axis of the heat sink.

The first reflector may include a cap part surrounding the upper portion of the mounting block and a reflective part extending from the outer circumferential surface of the cap part.

Mounting protrusions may be provided on the first substrates of the light emitting modules and mounting grooves into which the mounting protrusions are inserted may be provided at the cap part of the first reflector.

The reflective part may have a ring shape.

The reflective part may be upwardly or downwardly inclined at a designated angle with respect to the plurality of side surfaces of the mounting block.

The light emitting modules may be disposed on the top surface of the mounting block, and may further include a second substrate electrically connected to the electronic module and the first substrates of the light emitting modules.

A through hole through which a connector of the electronic module electrically connected to the second substrate passes may be provided on the mounting block.

Protrusions may be provided on the plurality of side surfaces of the mounting block, and grooves into which the protrusions are inserted may be provided on the first substrates of the light emitting modules.

The lighting apparatus may further include a first fastening member passing through the second substrate and fixed to the mounting block and a second fastening member passing through the first reflector and the second substrate and fixed to the mounting block.

The lighting apparatus may also include a second reflector mounted on heat sink and having downwardly inclined surfaces towards the heat sink from the plurality of side surfaces of the mounting block so as to prevent interference with light within the designated light distribution angle irradiated from the LEDs.

The inclined surfaces of the second reflector may be downwardly inclined at an angle of 120° to 140° with respect to the central axis of the heat sink.

The heat sink may include a mount part on which the mounting block is provided and a recess into which the second reflector is inserted and which is provided between the mount part and the plurality of heat radiation fins.

The second reflector may include a ring part surrounding a partial area or more of the mount part and an insertion groove part provided on the outer circumferential surface of the ring part such that the bulb is inserted into the insertion groove part.

The inclined surfaces of the second reflector may include a first inclined surface formed in the circumferential direction of the upper end of the ring part and second inclined surfaces formed at the upper end of the first inclined surface so as to surround a partial area or more of the first substrates of the light emitting modules.

The first inclined surface and the second inclined surfaces may be downwardly inclined at an angle of 120° to 140° with respect to the central axis of the heat sink.

The bulb may be detachably mounted on the insertion groove part.

The bulb may include a first diffusion part formed at the upper end thereof and a second diffusion part formed at the lower end thereof, and the first diffusion part and the second diffusion part may have different curvatures.

The lighting apparatus may further include a thermal conductive pad disposed between the mounting block and the light emitting modules.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus, comprising:

a heat sink having a plurality of fins;

a mounting block provided over the heat sink and having a top surface and a plurality of side surfaces;

a bulb provided over the heat sink and surrounding the mounting block;

at least one light emitting module, the at least one light emitting module including:

a first substrate provided on a corresponding one of the plurality of side surfaces of the mounting block; and LEDs mounted on the first substrate to emit light towards a corresponding side area of the bulb;

an electronic module electrically connected to the at least one light emitting module; and a first reflector mounted on the mounting block and reflecting light emitted from the LEDs towards a lower end area of the bulb, wherein the plurality of fins of the heat sink is separated from the lower end area of the bulb by a predetermined interval so as to prevent interference with light emitted from the LEDs within a predetermined light distribution angle, wherein the bulb includes a first diffusion section formed at an upper end thereof, and a second diffusion section formed at a lower end thereof, wherein the first diffusion section and the second diffusion section have different curvatures, wherein the first reflector includes a cavity surrounding the top surface of the mounting block and a reflective part extending from an outer circumferential surface of the cavity, and wherein a plurality of mounting protrusions are provided on the first substrate of the at least one light emitting module, and corresponding plurality of mounting grooves are provided at the cavity of the first reflector to receive the mounting protrusions therein.

2. The lighting apparatus of claim 1, wherein the plurality of fins include inclined surfaces having designated curvature formed at regions thereof corresponding to the lower end area of the bulb.

3. The lighting apparatus of claim 2, wherein a light distribution area is formed in a range of 120° to 140° with respect to a central axis of the heat sink, and wherein the plurality of fins do not extend into the light distribution area.

4. The lighting apparatus of claim 1, wherein the reflective part of the first reflector has a ring shape.

5. The lighting apparatus of claim 4, wherein the reflective part of the reflector is upwardly or downwardly inclined at a designated angle with respect to the plurality of side surfaces of the mounting block.

6. The lighting apparatus of claim 1, wherein the at least one light emitting module further comprises a second substrate provided on the top surface of the mounting block and electrically connected to the electronic module and to the first substrate of the at least one light emitting module.

7. The lighting apparatus of claim 6, wherein the mounting block comprises a through hole through which a connector of the electronic module is received so as to electrically connect the electronic module to the second substrate.

8. The lighting apparatus of claim 6, further comprising:

grooves formed in the first substrate of the at least one light emitting module; and protrusions provided on the plurality of side surfaces of the mounting block and inserted into the grooves so as to couple the first substrate to its respective side surface of the mounting block.

9. The lighting apparatus of claim 6, further comprising:

a first fastener that passes through the second substrate and into the mounting block to fix the second substrate to the mounting block; and a second fastener that passes through the first reflector and the second substrate and into the mounting block to fix the first reflector to the mounting block.

10. The lighting apparatus of claim 1, further comprising a second reflector mounted on the heat sink, wherein the second reflector includes downwardly inclined surfaces that extend at a downward incline from the plurality of side surfaces of the mounting block toward the heat sink so as to prevent interference with light emitted by the LEDs within the predetermined light distribution angle.

11. The lighting apparatus of claim 10, wherein the inclined surfaces of the second reflector are downwardly inclined at an angle of 120° to 140° with respect to a central axis of the heat sink.

12. The lighting apparatus of claim 10, wherein the heat sink includes a mount part on which the mounting block is received and a recess provided between the mount part and the plurality of fins so as to receive the second reflector therein.

13. The lighting apparatus of claim 12, wherein the second reflector includes a ring at least partially surrounding the mount part of the heat sink and an insertion groove provided on an outer circumferential surface of the ring such that the bulb is inserted into the insertion groove.

14. The lighting apparatus of claim 13, wherein the inclined surfaces of the second reflector include:

a first inclined surface formed in a circumferential direction of the upper end of the ring; and second inclined surfaces formed at an upper end of the first inclined surface so as to at least partially surround a the first substrate of the at least one light emitting module.

15. The lighting apparatus of claim 14, wherein the first inclined surface and the second inclined surfaces are downwardly inclined at an angle of 120° to 140° with respect to the central axis of the heat sink.

16. The lighting apparatus of claim 1, further comprising a thermal conductive pad disposed between the mounting block and the at least one light emitting module.

17. The lighting apparatus of claim 1, wherein the at least one light emitting module comprises a plurality of light emitting modules respectively corresponding to the plurality of side surfaces of the mounting block such that a light emitting module is respectively installed on each of the plurality of side surfaces of the mounting block.

* * * * *